US005221224A

United States Patent [19]

Satoh et al.

[11] Patent Number: 5,221,224

[45] Date of Patent: Jun. 22, 1993

[54] MOVABLE ARTICLE HAVING EXPANDING-CONTRACTING AND REVOLVING MOTION

[75] Inventors: Yasuta Satoh, Nagareyama; Hatsuo Ohkoshi, Narita, both of Japan

[73] Assignee: Takara Co., Ltd., Tokyo, Japan

[21] Appl. No.: 719,129

[22] Filed: Jun. 20, 1991

[30] Foreign Application Priority Data

Feb. 8, 1991 [JP] Japan ..... 3-11651

[51] Int. Cl.[5] ..... A63H 33/26

[52] U.S. Cl. ..... 446/175; 446/465; 40/414

[58] Field of Search ..... 446/175, 437, 462, 484, 446/287, 288, 236, 237, 238, 465, 457; 40/414, 411

[56] References Cited

U.S. PATENT DOCUMENTS

| | | | |
|---|---|---|---|
| 1,261,300 | 4/1918 | Saxon . | |
| 2,875,538 | 3/1959 | Faville et al. . | |
| 3,039,615 | 6/1962 | Uihlein et al. . | |
| 3,119,201 | 1/1964 | Brown et al. | 446/175 |
| 3,444,646 | 5/1969 | Domashovetz | 446/175 |
| 3,458,950 | 9/1969 | Tomaro et al. | 446/175 |
| 3,486,260 | 12/1969 | Ward . | |
| 4,097,917 | 6/1978 | McCaslin | 446/175 X |
| 4,182,077 | 1/1980 | Wagner et al. | 446/484 |
| 4,453,340 | 6/1984 | Kozuka et al. | 446/437 |
| 4,516,951 | 5/1985 | Saigo et al. | 446/338 |
| 4,545,775 | 10/1985 | Kim | 446/299 |
| 4,582,317 | 4/1986 | Provenzano, Jr. | 272/8 N |
| 4,717,364 | 1/1988 | Furukawa | 446/175 |
| 4,765,079 | 8/1988 | Takahashi | 40/439 |
| 4,775,351 | 10/1988 | Provenzano, Jr. | 446/175 |
| 4,775,352 | 10/1988 | Curran et al. | 446/301 |
| 4,810,227 | 3/1989 | Kim | 446/354 |
| 4,828,530 | 5/1989 | Lee | 446/354 |
| 4,850,930 | 7/1989 | Sato et al. | 446/175 |
| 4,903,424 | 3/1990 | Satoh et al. | 40/414 |
| 4,923,428 | 5/1990 | Curran | 446/175 |
| 4,939,944 | 7/1990 | Hou | 446/352 X |
| 4,943,256 | 7/1990 | Symons | 446/437 X |
| 5,003,714 | 4/1991 | Satoh et al. | 40/414 |

FOREIGN PATENT DOCUMENTS

| | | | |
|---|---|---|---|
| 0036797 | 9/1981 | European Pat. Off. . | |
| 0067052 | 12/1982 | European Pat. Off. . | |
| 147496 | 2/1903 | Fed. Rep. of Germany . | |
| 154190 | 6/1990 | Japan . | |
| 237083 | 7/1925 | United Kingdom . | |
| 1305333 | 1/1973 | United Kingdom . | |
| 2186204 | 8/1987 | United Kingdom . | |
| 2221401 | 2/1990 | United Kingdom . | |
| 2229646 | 7/1990 | United Kingdom | 446/175 |
| 2231279A | 11/1990 | United Kingdom . | |

OTHER PUBLICATIONS

European search report of co-pending U.K. application.

*Primary Examiner*—Mickey Yu

*Attorney, Agent, or Firm*—Price, Gess & Ubell

[57] ABSTRACT

A movable article capable of exhibiting a unique and complicated motion sufficient to attract a viewer. A motor is driven depending upon detection of sound by a sensor switch, so that the movable article may carry out a linear expanding-contracting motion in the vertical direction while simultaneously carrying out a revolving motion about a vertical axis. A position switch ensures that the movable article returns to its upright position.

15 Claims, 10 Drawing Sheets

MOVABLE ARTICLE HAVING EXPANDING-CONTRACTING AND REVOLVING MOTION

BACKGROUND OF THE INVENTION

This invention relates to a movable article having expanding-contracting and revolving motion, and more particularly to a movable article which is adapted to simultaneously accomplish revolving motion about a vertical axis, as well as linear expanding-contracting motion in the vertical direction, upon detection or sensing of any desired external stimulus such as sound, light or the like.

A movable article of the above-described type which has been conventionally known in the art is constructed so as to carry out only oscillating and bending motion. Thus, the conventional movable article fails to exhibit complicated motion sufficient to substantially attract a viewer.

Thus, it would be highly desirable to develop a movable article which is capable of exhibiting more complicated and unique motion sufficient to not only permit a viewer to feel interest and surprise but substantially attract the viewer.

SUMMARY OF THE INVENTION

The present invention has been made in view of the foregoing disadvantage of the prior art.

Accordingly, it is an object of the present invention to provide a movable article which is capable of exhibiting complicated motion full of variety.

It is another object of the present invention to provide a movable article which is capable of substantially attracting a viewer.

Is is a further object of the present invention to provide a movable article which is capable of carrying out expanding-contracting motion while carrying out revolving motion.

In accordance with the present invention, a movable article is provided which is capable of an expanding-contracting and revolving motion and includes a power supply to which a sensor switch is connected for detecting an external stimulus, a motor connected through the sensor switch to the power supply, and a drive circuit for selectively supplying power from said power supply to said motor. The movable article comprises a base section having a bottom, and a reciprocation section mounted on said base section so as to carry out linear reciprocative motion in a vertical direction relative to said base section when the movable article is resting on a generally horizontal support surface. The base section includes a drive section having a gear train driven by said motor, a reciprocative actuation mechanism having an eccentric pin driven by said drive section and arranged eccentric from a horizontal axis so as to be rotated about said horizontal axis and a connection member for operatively connecting said eccentric pin to said reciprocation section, and a revolving motion mechanism having a wheel arranged in a manner to downwardly project at a part of the periphery thereof from the bottom of said base section and driven by said drive section and at least one projection arranged so as to project at a part thereof from the bottom of said base section, so that the movable article carries out a linear expanding- contracting motion in the vertical direction and a revolving motion about a vertical axis when said sensor detects an external stimulus.

In the movable article of the present invention constructed as described above, when the sensor detects a predetermined external stimulus such as sound, light or the like, the motor is driven to permit the whole movable article to simultaneously carry out linear expanding-contracting motion in the vertical direction and revolving motion in a vertical axis, so that the movable article may exhibit complicated motion sufficient to attract a viewer.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a movable article having expanding-contracting and revolving motion according to the present invention will be described hereinafter with reference to the accompanying drawings.

FIGS. 1 to 7 show an embodiment of a movable article according to the present invention.

Figure 1:
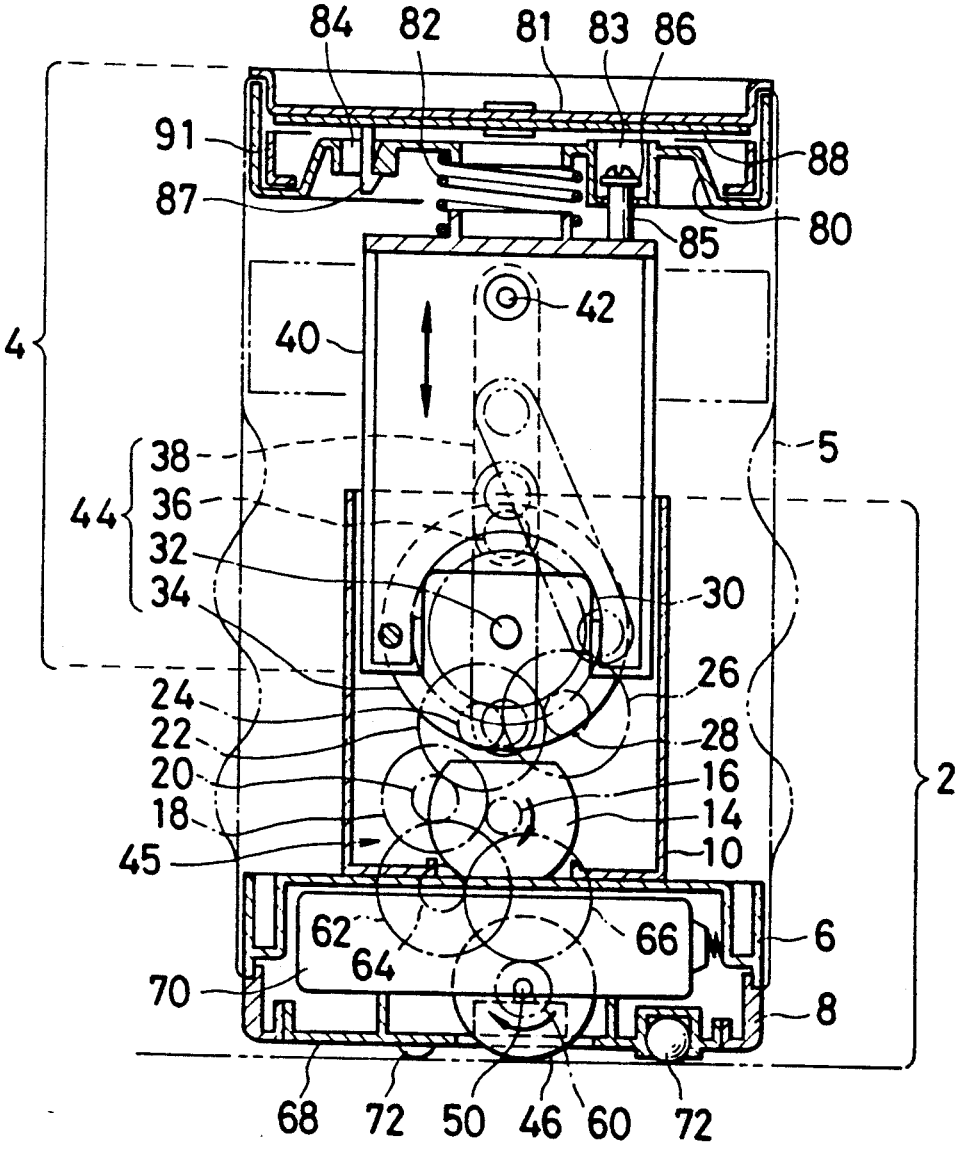
FIG. 1 is a vertical sectional front elevation view showing an embodiment of a movable article according to the present invention.
Figure 2:
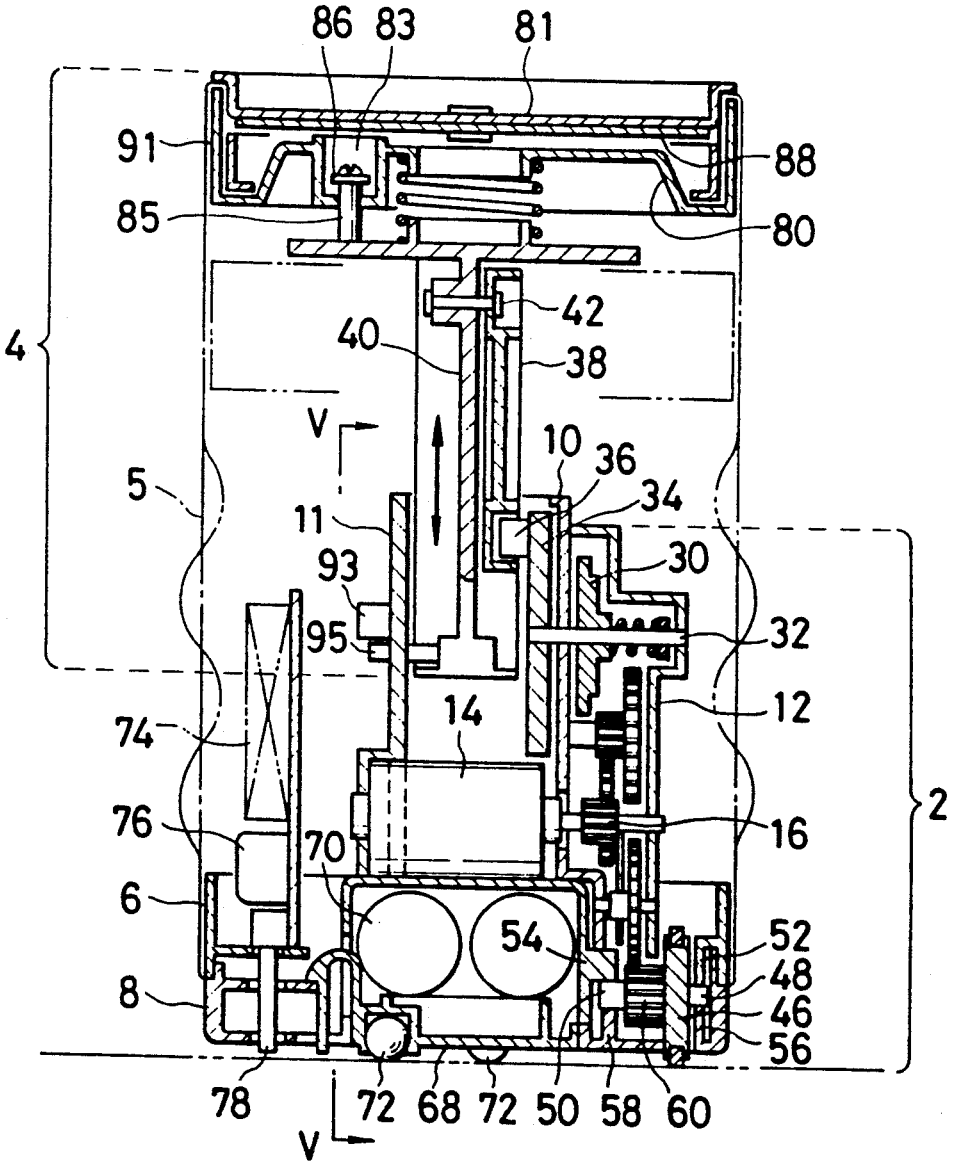
FIG. 2 is a vertical sectional side elevation view of the movable article shown in FIG. 1.

A movable article of the illustrated embodiment, as shown in FIGS. 1 and 2, generally includes a base section 2 and a reciprocation section 4. The movable article also includes a deformable outer side wall or cover 5 formed into a cylindrical shape. The deformable cylindrical side wall 5 may be made of a soft and flexible sheet material and is fixed at the upper and lower ends thereof to the reciprocation section 4 and base section 2, respectively.

The base section 2 includes a bottom frame 6, a bottom lid 8, a guide frame 10, a wall plate 11 and a gear box 12. The reciprocation section 4 is supported above the base section 2 so as to be accessible or linearly reciprocatable with respect to the base section 2 in the guide frame 10.

Reference numeral 14 designates a motor which is arranged on the bottom frame 6 and includes a pinion 16. The driving force of the motor 14 is transmitted to the pinion 16. The force is then transmitted from the pinion 16 through a reduction gear train operatively connected to the pinion 16 and including gears 18, 20, 22, 24, 26, 28 and 30 to a disc 34 operatively connected to the reduction gear train and rotated about a horizontal shaft 32. The disc 34 has a pin 36 eccentrically mounted thereon, so that the driving force thus transmitted causes the eccentric pin 36 to be revolved about the horizontal shaft 32. Reference numeral 38 designates a connection member which functions to operatively connect the eccentric pin 36 and a pin 42 of a slider 40 provided at the reciprocation section 4 to each other to convert revolution of the eccentric pin 36 to linear reciprocation of the slider 40 and therefore linear reciprocation of the reciprocation section 4. In the illustrated embodiment, the connection member 38 comprises a connection rod.

The above-described horizontal shaft 32, disc 34, eccentric pin 36 and connection rod 38 cooperate together to provide a reciprocative actuation mechanism 44 for reciprocating the reciprocation section 4.

The reduction gear train comprising the gears 18, 20, 22, 24, 26, 28 and 30 cooperates with a gear train including gears 62, 64 and 66 and detailedly described hereinafter, to thereby form a drive section 45.

The movable article of the illustrated embodiment further includes a wheel 46 vertically arranged in proximity to the outer periphery of the bottom lid 8 in such a manner that a part thereof downwardly and outwardly projects from the bottom lid 8 and is rotatably supported through horizontal axles 48 and 50 on the base section 2. The axles 48 and 50 are integrally formed with a gear 60 through which both axles are connected to each other. The axle 48 is interposedly supported between a first upper bearing 52 of the bottom frame 6 and a first lower bearing 56 of the bottom lid 8 and the axle 50 is interposedly supported between a second upper bearing 54 of the bottom frame 6 and a second lower bearing 58 of the bottom lid 8.

The driving force of the motor 14 transmitted to the pinion 16 is also transmitted through a gear train comprising the gears 18, 20, 62, 64, 66 and 60 to the wheel 46, resulting in the wheel being rotated.

In the bottom frame 6 is held a battery means 70 such as at least one cell by means of a battery lid 68. The movable article is provided on the outer bottom surface thereof with a projection means 72 for guiding or promoting motion of the article. In the movable article of the illustrated embodiment, the projection means 72 comprises at least one ball movably or rotatably held on the battery lid 68 so that a part thereof outwardly and downwardly projects therefrom. In the illustrated embodiment, one such ball is arranged. The ball 72 may be arranged on the bottom lid 8 rather than the battery lid 68. Alternatively, the projection means 72 may comprise at least one fixed projection or rotatable wheel (coupled driving wheel) provided on the battery lid 68 and/or bottom lid 8. The projection may be formed integral with the lid 8 and/or lid 68.

The wheel 46 and projection means 72 are preferably positioned so that when the movable article is revolved, the axis of revolution of the article is deviated from the geometrically central axis of the movable article or the central axis of configuration of the article.

Reference numerals 74, 76 and 78 indicate a drive circuit, a sensor such as a microphone for sensing external sound and a main switch, respectively.

The reciprocation section 4 includes a slider 40, a top frame 80, a top lid 81 fitted in the upper portion of the top frame 80, and a spring 82 interposedly arranged between the top frame 80 and the slider 40.

Figure 3:
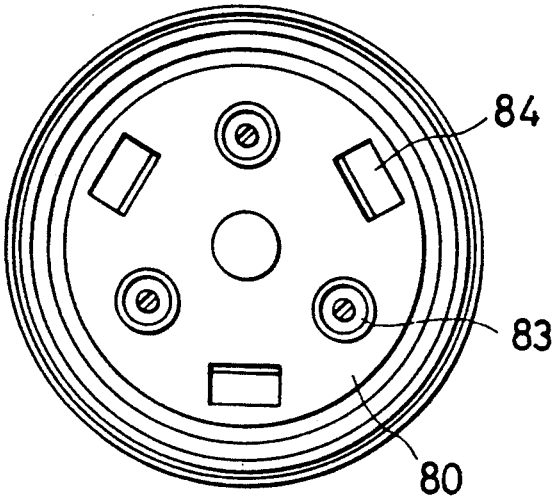
FIG. 3 is a plan view of the movable article shown in FIG. 1 from which a top lid is removed.
Figure 4:
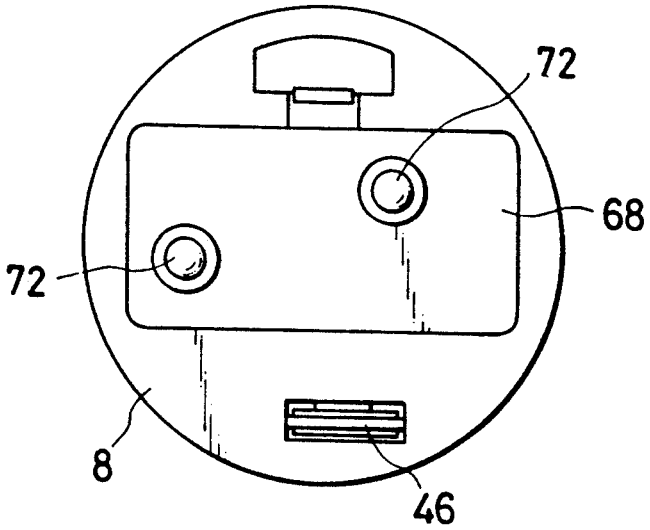
FIG. 4 is a bottom view of the movable article shown in FIG. 1.

The top frame 80, as shown in FIG. 3, is provided with a plurality of circular holes 83 and a plurality of rectangular holes 84. In each of the circular holes 83 is inserted each of a plurality of pins 85 provided on the top surface of the slider 40 in a manner to correspond to the circular holes 83. The pin 85 is provided with a washer 86, which functions to prevent each of the pins 85 from being disconnected from the corresponding circular hole 83, to thereby restrict a distance at which the top frame 80 is spaced or separated from the slider 40 by the spring 82.

The top lid 81, as shown in FIG. 1, has backing plates 88 mounted on the lower surface thereof, each of which is provided thereon with a downwardly extending hook 87. The hooks 87 are adapted to be engagedly held in the corresponding rectangular holes 84 to hold the top lid 81 in the top frame 80 when the top plate 81 is forced into the top frame 80.

The deformable cylindrical side wall or cover 5, as described above, is made of a soft and flexible sheet material such as a vinyl sheet material or the like. The side wall 5 is interposedly held at the upper end thereof between the top lid 81 and the top frame 80 and then between the top frame 80 and a holding ring 91 fittedly arranged in the top frame 80, resulting in being fixedly connected to the reciprocation section 4. Also, the side wall 5 is interposedly held at the lower end thereof between the bottom frame 6 and the bottom lid 8, resulting in being fixedly connected to the base section 2. Thus, in the illustrated embodiment, the deformable cylindrical side wall 5 is arranged so as to cover or surround at least the lower portion of the reciprocation section 4 and the upper portion of the base section 2. Also, such arrangement of the side wall 5 causes the side wall 5 to be placed under tension of the spring 82, resulting in the movable article keeping a cylindrical shape, when the reciprocation section 4 is at the highest position.

Figure 6:
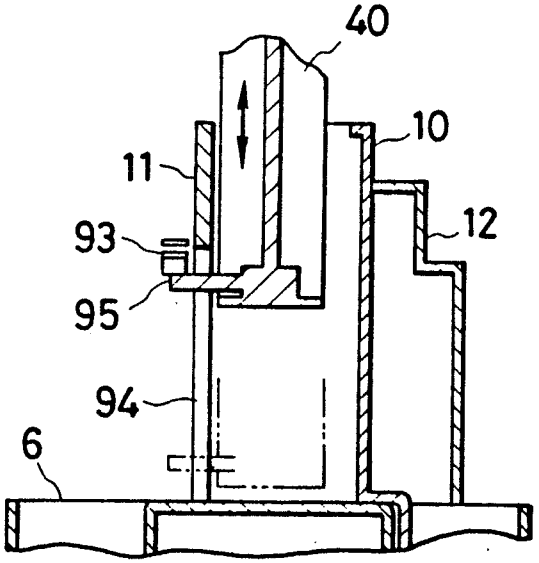
FIG. 6 is a sectional view taken along line VI—VI of FIG. 5.
Figure 5:
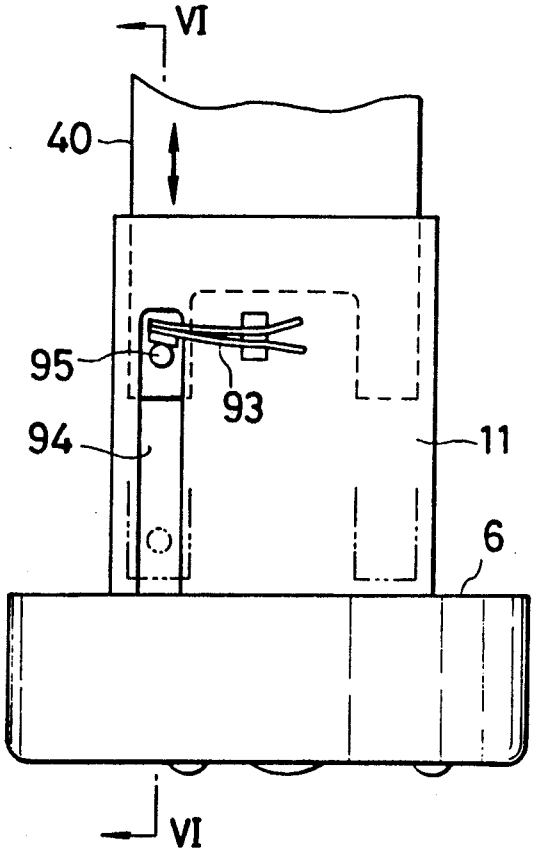
FIG. 5 is a sectional view taken along line V—V of FIG. 2.

The movable article of the illustrated embodiment, as shown in FIGS. 5 and 6, further includes a position detecting switch 93 and correspondingly the slider 40 is provided with a striker 95. The striker 95 is so arranged that it extends through an aperture 94 of the wall plate 11 to contact with the position detecting switch 93 when the reciprocation section 4 is at a particular position with respect to the base section 2 such as, for example, at the highest position farthest from the base section 2, resulting in the position detecting switch 93 generating a signal.

Figure 7:
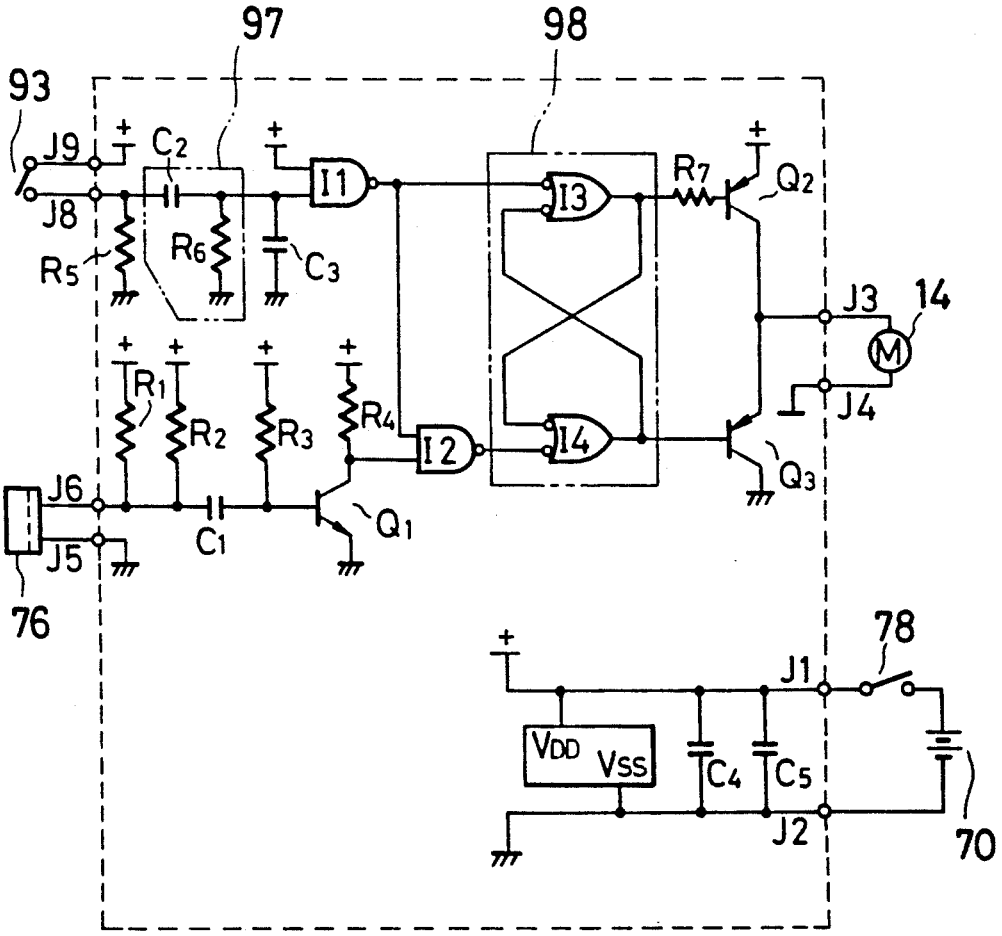
FIG. 7 is a circuit diagram showing a drive circuit of the movable article shown in FIG. 1.

The drive circuit 72 may be constructed in such a manner as shown in FIG. 7, wherein reference numerals 97 and 98 designate a differentiating circuit and a flip-flop circuit, respectively.

Now, the manner of operation of the movable article of the illustrated embodiment described above will be described hereinafter in combination with the operation of the drive circuit 74.

As described below, the movable article of the illustrated embodiment is adapted to be kept stationary when the reciprocation section 4 reaches the highest position to cause the movable article to extend in its full length. At this state, the position detecting switch 93 is turned on, so that the movable article is kept stationary unless the sensor 76 detects sound of a predetermined level or more. Then, when the sensor detects sound of a predetermined level or more; a transistor $Q_1$ is turned on, a flip-flop circuit 98 is set, a transistor $Q_2$ is turned off and a transistor $Q_3$ is turned on, resulting in the motor 14 starting. This causes the reciprocation section 4 to be lowered through the gears 18 to 30 and reciprocative actuation mechanism 44, so that the movable article starts contracting motion. Concurrently, the wheel 46 is rotated through the gears 60 to 66, so that the projection means 72 causes the movable article to start irregular revolution about the eccentric vertical axis.

The position detecting switch 93 is turned off immediately after the motor 14 starts, however, the level of a signal generated from the switch 93 is not varied because the output of the differentiating circuit 97 is a pulse in a negative direction; so that the motor 14 continues rotation.

In such a state, even when sound to be detected is extinguished or diminished below a predetermined level to cause the transistor $Q_1$ to be turned on, the output of the flip-flop circuit is not varied. Accordingly, the motor 14 continues rotation, so that the movable article contracted starts expanding motion again while continuing irregular revolving motion.

When the movable article extends in the full length to cause the reciprocation section 4 to reach the highest position, the position detecting switch 93 is then turned on. At this time, the output of the differentiating circuit 97 is varied to a pulse in a positive direction which is kept at a high level during time T, during which the output of a NAND circuit $I_1$ is kept at a low level. This results in the flip-flop circuit 98 being reset, the transistor $Q_2$ being turned on and the transistor $Q_1$ being turned off, so that the motor 14 stops rotation to cause the movable article to stop expanding-contracting and revolving motion while extending in the full length.

The movable article is kept stationary so long as sound detected through the sensor 76 is below a predetermined level, even when the output of the NAND circuit $I_1$ is returned to a high level after the time T elapses. However, when the sensor 76 detects sound of a predetermined level or more, the flip-flop circuit 98 is set, to thereby cause the motor 14 to restart.

However, during the time T immediately after the position detecting switch 93 is turned on, even when the sensor 76 detects sound of a predetermined level or more, the NAND circuit $I_2$ acts as an inhibiting gate and the differentiating circuit 97 and NAND circuits $I_1$ and $I_2$ cooperate with one another to form an inhibiting circuit, to thereby inhibit a signal generated from the sensor 76 from affecting the flip-flop circuit 98, resulting in the motor 14 being kept non-actuated.

Thus, even when the sensor 76 continues to detect external sound of a predetermined level or more, the movable article is temporarily rendered stationary whenever it extends in the full length. Then, so long as the sensor 76 still continues to detect the sound, the movable article restarts the motion after the time T elapses.

In the illustrated embodiment, the sensor 76 comprises a sound sensor. However, any other sensor adapted to detect external stimulus other than sound such as light, heat, infrared rays, vibration or the like may be suitably used in the present invention.

Thus, it will be noted that the movable article of the illustrated embodiment attains revolving motion about a vertical axis while concurrently carrying out linear expanding-contracting motion in the vertical direction upon detection of predetermined external stimulus such as sound or the like, therefore, it exhibits unique complicated motion sufficient to attract a viewer.

Also, when the projection means 72 such as a ball is suitably positioned with respect to the wheel 46 arranged on the bottom surface of the base section 2 so as to cause the axis of revolving motion of the movable article to be eccentric with respect to the axis of configuration of the movable article, the revolving motion is eccentrically accomplished; therefore, the whole motion of the movable article is more complicated and/or unique, resulting in further fascinating a viewer. This is likewise attained when the movable article is so constructed that the projection means 72 comprising a fixed projection formed on the bottom surface of the base section 2 is arranged at a position deviated from the center of the bottom surface of the base section 2 to cause the axis of revolving motion of the movable article to be deviated from the axis of configuration of the movable article. In such construction, the friction between the projection means and a plane on which the movable article is placed, the deviation between the center of gravity of the movable article and the axis of revolving motion of the article and the like cause the axis of the revolving motion to be varied, so that the eccentric revolving motion may be rendered irregular, resulting in the whole motion of the movable article being further complicated.

Also, in the illustrated embodiment, the transistors $Q_2$ and $Q_3$ each serving as a switching element for starting and stopping actuation of the motor are operated through the flip-flop circuit 98. Such construction, so long as the movable article starts the expanding-retracting and revolving motion due to detection of sound of a predetermined level or more through the sensor 76, permits it to continue the motion even when sound detected by the sensor is reduced below the predetermined level. In addition, the illustrated embodiment, as described above, may be so constructed that the position detecting switch is arranged so as to detect a particular position of the reciprocation section 4 with respect to the base section 2 such as, for example, a position at which the reciprocation section 4 extends in the full length. Such construction permits the movable article being actuated to be stopped when it reaches a posture predetermined. Thus, when the movable article is so constructed that the motion is continued even when sound is not detected and stopped when it takes a predetermined posture, the motion is more varied to further attract a viewer.

FIGS. 8 to 12 show another embodiment of a movable article according to the present invention.

Figure 8:
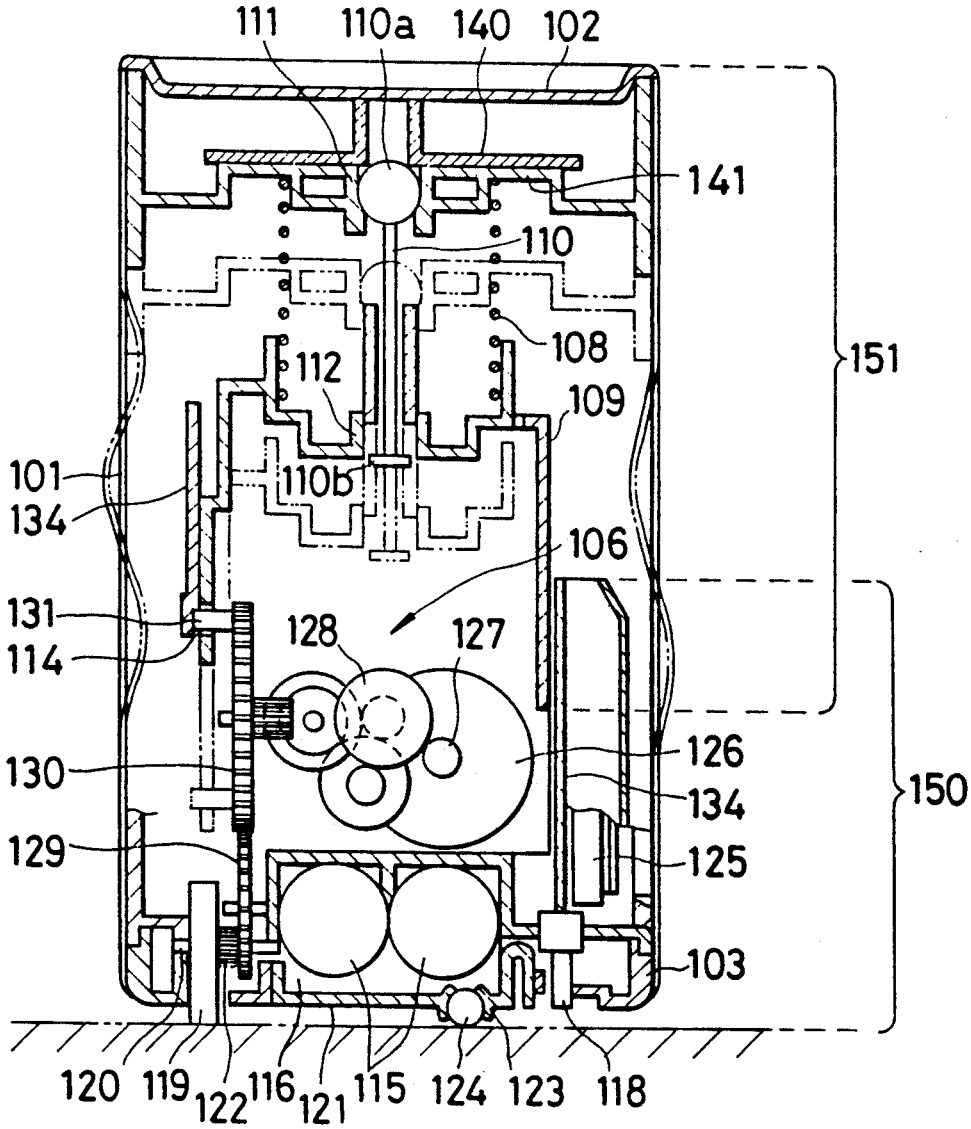
FIG. 8 is a vertical sectional front elevation view showing another embodiment of a movable article according to the present invention.
Figure 11A:
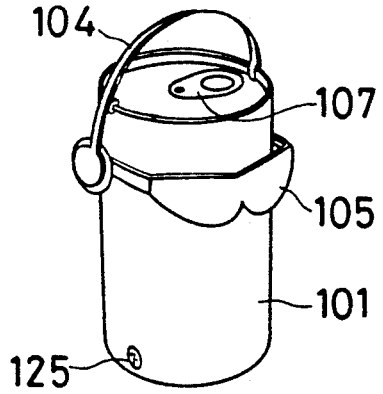
FIGS. 11(*a*), 11(*b*) and 11(*c*) each are a schematic perspective view showing the manner of operation of the movable article shown in FIG. 8.
Figure 11B:
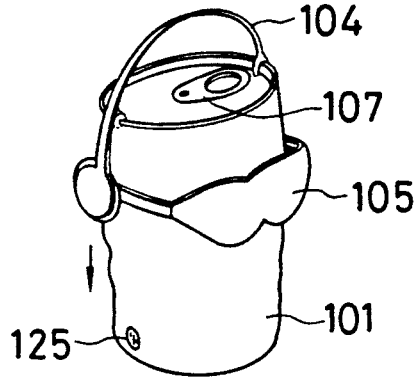
Figure 11C:
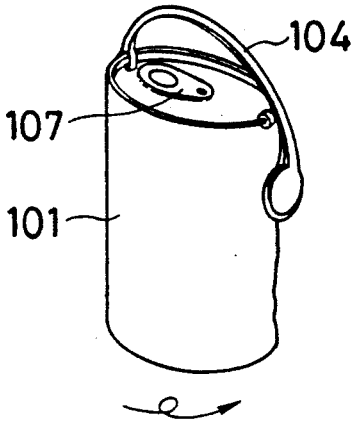

A movable article of the illustrated embodiment, as shown in FIG. 8, includes an outer configuration comprising a base section 150, a reciprocation section 151, a deformable cylindrical side wall 101 made of a soft and flexible sheet material such as a vinyl sheet material, and a top lid 102 and a bottom lid 103 respectively connected to the upper and lower ends of the deformable side wall 101. On the upper portion of the movable article is mounted a decorative member 104 formed in imitation of a headphone and on the front portion of the movable article is mounted another decorative member 105 made in imitation of a glass, as shown in FIGS. 11(*a*) to 11(*c*). In the movable article is arranged a drive section 106.

On the outer surface of the top lid 102 is provided a pull-top piece 107. On the back or lower surface of the top lid 102 are mounted a holding plate 140 and a top frame 141, which are supported through a spring 108 on a slider 109. The slider 109 is arranged in a guide frame 134 of the base section 150 so as to be vertically slidable therein. The slider 109 is operatively connected through a vertical support member 110 to the top frame 102. The support member 110 is provided at one end or the upper end thereof with a ball 110*a*, which is then received in a recess or depression 111 formed at the central portion of the back or lower surface of the top frame 102. The support member 110 is provided at the other end or lower end thereof with a holder 110*b*, which is held in a recess 112 provided at the center of the upper portion of the slider 109. The so-arranged spring 108 and support member 110 function to upwardly force the top frame 102 with respect to the slider 109 and prevent disconnection between both.

Figure 10:
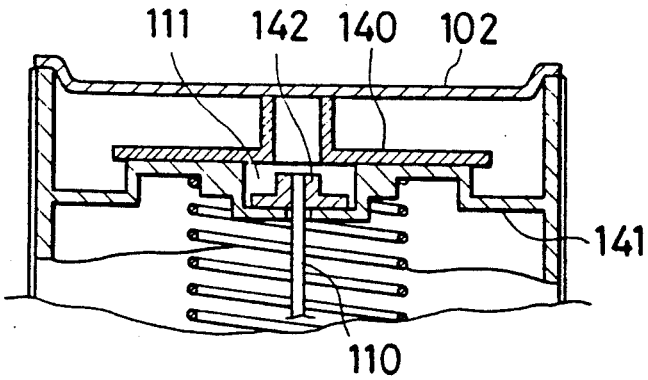
FIG. 10 is a fragmentary vertical sectional front elevation view showing a modification of the movable article shown in FIG. 8.

The ball 110*a* may be replaced with a flange 142 as shown in FIG. 10.

The slider 109 is integrally formed on one side thereof with a connection member. In the illustrated embodiment, the connection member comprises an aperture formed member 109*a* formed into an inverted T-shape, which is formed at the lower horizontal portion thereof with an elongated hole 114 extending in the longitudinal direction of the horizontal portion.

The bottom lid 103 is provided in the central portion thereof with a battery casing 116 for receiving therein a battery means 115 serving as a power supply. On one side of the battery casing 116 is provided a main switch 118. Also, the battery casing 116 is provided on the other side thereof with a wheel 119, which is rotatably supported on a support shaft 120 so as to function as a rotator. The battery means 115 may comprise at least one cell and is replaceable by removing a battery lid 121 from the battery casing 116. The main switch 118 can be readily operated from the bottom side of the movable article. The rotator or wheel 119 is arranged so as to partially outwardly project from the bottom of the movable article and the support shaft 120 for the wheel 119 has a gear 122 fixedly mounted thereon. The battery casing 121 is provided on the side thereof on which the main switch 118 is arranged with a recess 123, in which a ball 124 is received in a manner to partially outwardly project therefrom.

Figure 12:
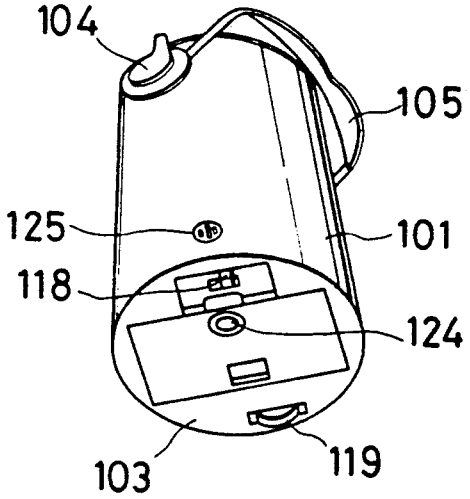
FIG. 12 is a perspective view of the movable article shown in FIG. 8 which is observed from the bottom side of the movable article.

The movable article of the illustrated embodiment, as shown in FIG. 8, also includes a sensor 125 for detecting sound of a predetermined level or more, which is arranged in proximity to one side of the bottom lid 103 in a manner to be exposed at a part thereof, as shown in FIGS. 11 and 12.

The drive section 106 includes a motor 126 acting as a drive source and a plurality of reduction gears. More particularly, the motor 126 includes a revolving shaft having a gear 127 fixed thereon, which is then engaged with a gear 128 which is one of the reduction gears. A gear 129 which is another one of the reduction gears is engaged with a gear 122 fixed on the support shaft 120 of the wheel 119. A gear 130 which is another one of the reduction gears is provided with an eccentric pin 131 on the portion of the surface thereof in proximity to the outer periphery thereof in a manner to be deviated from the center of the gear 130. The eccentric pin 131 is inserted in the elongated hole 114 of the inverted T-shaped member 109*a* of the slider 109. Such construction, when the motor 126 is rotated, causes the slider 109 to be vertically moved, resulting in the deformable cylindrical side wall 101 exhibiting expanding-contracting motion and the wheel 119 being rotated. The inverted T-shaped member 109*a* causes the eccentric pin 131 and reciprocation section 151 to be operatively connected to each other therethrough, so that revolving motion of the eccentric pin 131 may be converted into linear reciprocating motion of the reciprocation section 151. Thus, the eccentric pin 131, inverted T-shaped member 109*a* and elongated aperture 114 cooperate with one another to form a reciprocative actuation mechanism 113.

Figure 9:
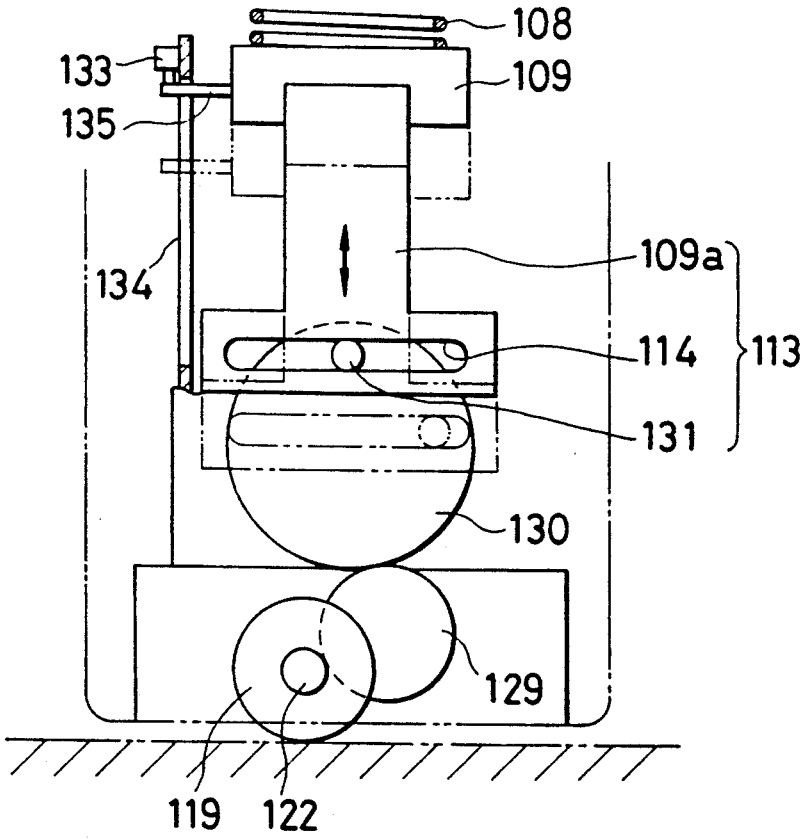
FIG. 9 is a schematic vertical sectional view of the movable article shown in FIG. 8.

Reference numeral 133 designates a leaf switch serving as a position detecting switch. For this purpose, the leaf switch 133, as shown in FIG. 9, is fixed on a guide frame 134 functioning as a guide for the slider 109. The slider 109 is provided on the side surface thereof with a striker 135 in a manner to project therefrom, which is adapted to be abuttedly engaged with the leaf switch 135 when the slider 109 is moved to the highest position, to thereby actuate the leaf switch 135, resulting in rotation of the motor 126 being temporarily stopped. A drive circuit for the motor 126 may be constructed in the same manner as that shown in FIG. 7.

The remaining part of the embodiment shown in FIGS. 8 to 12 may be constructed in substantially the same manner as the embodiment described above with reference to FIGS. 1 to 7.

Now, the manner of operation of the movable article of the illustrated embodiment constructed as described above will be described hereinafter.

When the sensor switch 125 detects sound of a predetermined magnitude or more, the motor 126 is rotated to actuate the drive section 106 including a plurality of reduction gears, to thereby lower the slider 109 operatively connected to the drive section 106 through the reciprocative actuation mechanism 113, so that the movable article is contracted as shown in FIG. 11(*b*). Concurrently, the rotator or wheel 119 operatively connected to the drive section 106 is actuated or rotated, so that the movable article is moved while carrying out revolving motion as shown in FIG. 11(*c*).

The striker 135 mounted on the side surface of the slider 109 in a manner to project therefrom is kept abuttedly engaged with the leaf switch 133. However, when the slider 109 is lowered, the striker 135 is disengaged from the leaf switch 133, so that it is turned off. Then, when the slider 109 is raised to the uppermost position, the striker 135 is engaged with the leaf switch 133, resulting in the switch being turned on. This causes the actuation of the motor 126 to be temporarily stopped, so that the movable article is returned to the original state of extending in the full length and the rotator or wheel 119 is temporarily stopped.

Then, when the sensor 125 detects sound of a predetermined level or more again while the movable article is kept at this state, the movable article repeats the above-described operation of moving while carrying out expanding-contracting and revolving motion.

Figure 13:
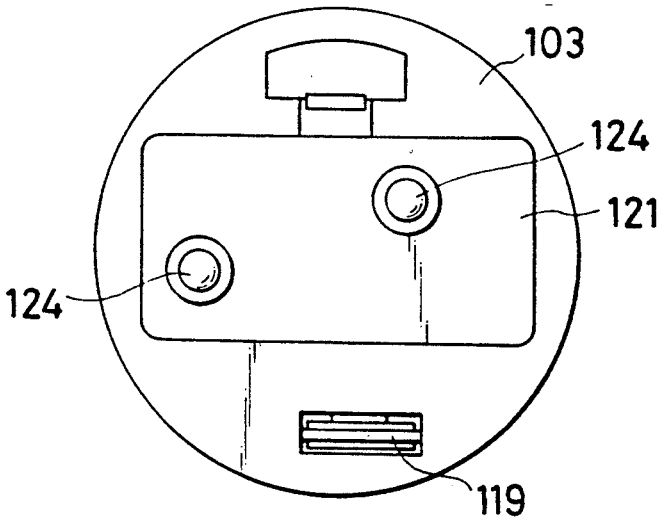
FIG. 13 is a bottom view showing another modification of the movable article shown in FIG. 8.

FIG. 13 shows another modification of the movable article shown in FIG. 8, wherein two balls 124 are arranged on the bottom of the movable article. The remaining part of the modification may be constructed in substantially the same manner as the embodiment of FIG. 8.

Figure 14:
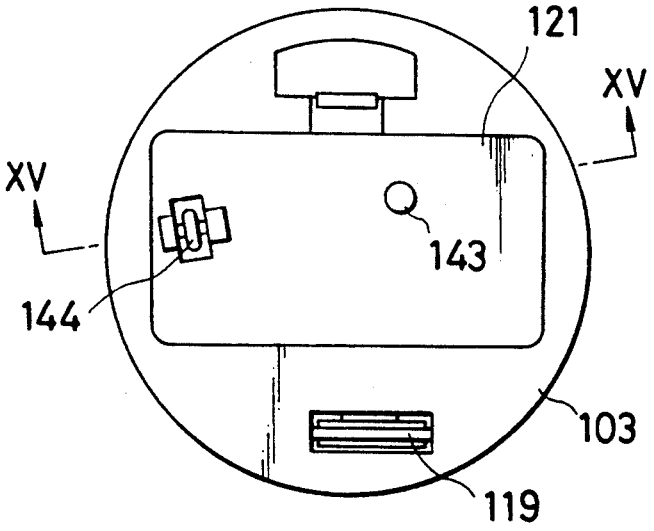
FIG. 14 is a bottom view showing a further modification of the movable article shown in FIG. 8.
Figure 15:
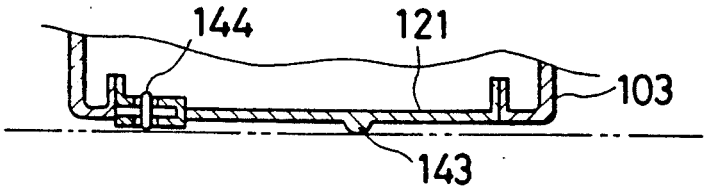
FIG. 15 is a sectional view taken along line XV—XV of FIG. 14.

FIGS. 14 and 15 show a further modification of the embodiment shown in FIG. 8, wherein a projection means is constructed in a manner different from the embodiment.

More particularly, the projection means comprises a a fixed projection 143 formed integral with a battery lid 121 and a small wheel 144 rotatably supported on the battery lid 121. The fixed projection 143 is arranged at a position deviated from the center of a bottom lid 103. Revolving motion of the movable article substantially depends upon the fixed projection, resulting in being eccentrically carried out. The remaining part of the modification may be constructed in substantially the manner as the embodiment of FIG. 8.

The embodiments described above each are so constructed that the outside is covered with the deformable cylindrical sheet material. Alternatively, the movable article of the present invention may be configured in imitation of a doll having a hula hoop arranged around the waist, a ballet doll putting on a skirt which is adapted to flare depending upon revolving motion, an animal, a utensil or the like.

As can be seen from the foregoing, the movable article of the present invention is constructed so as to accomplish expanding-contracting motion, as well as revolving motion about a vertical axis depending upon external stimulus. Thus, it will be noted that the movable article of the present invention exhibits complicated and/or unique motion sufficient to attract and fascinate a viewer.

While preferred embodiments of the present invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A movable article being capable of an expanding-contracting and revolving motion and including a power supply to which a sensor switch is connected for detecting an external stimulus, a motor connected through the sensor switch to the power supply, and a drive circuit for selectively supplying power from said power supply to said motor, comprising:

a base section having a bottom, with a cavity to receive batteries and a cover plate for securing the batteries within the cavity, and a reciprocation section mounted on said base section so as to carry out linear reciprocative motion in a vertical direction relative to said base section when the movable article is resting on a generally horizontal support surface, said base section including a drive section having a gear train driven by said motor, a reciprocative actuation mechanism having an eccentric pin driven by said drive section and arranged eccentric from a horizontal axis so as to be rotated about said horizontal axis and a connection member for operatively connecting said eccentric pin to said reciprocation section, and a revolving motion mechanism having a wheel arranged in a manner to downwardly project at a part of the periphery thereof from the bottom of said base section to contact a support surface and driven by said drive section and at least a second rotatable wheel arranged on said cover plate so as to project at a part thereof from the bottom of said base section to contact the support surface, whereby said movable article carries out a linear expanding-contracting motion in the vertical direction and a revolving motion about a vertical axis when said sensor switch detects an external stimulus.

2. A movable article as defined in claim 1, wherein said connection member comprises a connection rod for connecting said eccentric pin and reciprocation section to each other, resulting in a crank mechanism being formed.

3. A movable article as defined in claim 1, wherein said connection member comprises an aperture formed member held on said reciprocation section and formed with an elongated aperture in which said eccentric pin is engaged.

4. A movable article as defined in claim 1, wherein said base section and said reciprocation section are covered by a deformable side wall made of a soft and flexible sheet material, said deformable side wall being fixed at the upper end thereof on said reciprocation section and at the lower end thereof on said base section.

5. A movable article as defined in claim 1, further comprising a position detecting switch for detecting when said reciprocation section reaches a position predetermined in relation to said base section.

6. A movable article as defined in claim 5, wherein said predetermined position is a position at which said reciprocation section is farthest spaced from said base section.

7. A movable article as defined in claim 5, wherein said drive circuit includes an inhibiting circuit for keeping actuation of said motor stopped for a predetermined period of time after said reciprocation section reaches a predetermined position, irrespective of detection of external stimulus by said sensor switch.

8. A movable article as defined in claim 1, wherein said wheel and projection are arranged at positions which permit said movable article to carry out a revolving motion about a vertical axis deviated from the central verticle axis of said movable article.

9. A movable article as defined in claim 1, wherein said second rotatable wheel comprises a ball rotatably arranged at said base section.

10. A movable article as defined in claim 1, further including a single fixed projection for contacting the support surface.

11. A movable article as defined in claim 10, wherein said fixed projection is arranged at a position deviated from the center of the bottom surface of said base section.

12. A battery operated movable novelty device capable of simulating the appearance of a hand-held elongated container, comprising:

an upper lid member providing a rigid cylindrical configuration;

a lower lid member providing a rigid cylindrical configuration, the lower lid member having a compartment accessed through a closable opening member;

a battery member positioned within the lower lid member compartment;

a wheel member mounted adjacent a peripheral edge of a bottom surface of the lower lid member;

a pivot member mounted on the bottom surface of the closable opening member;

a motor assembly mounted on the lower lid member and operatively connected to the battery member;

a flexible cylindrical casing, shaped to simulate the casing of the container, the casing being attached to, respectively, the upper and lower lid members and enclosing the motor assembly;

means for biasing the upper and lower lid members away from each other to cause the flexible cylindrical casing to assume a cylindrical shape in a stationary position;

means, connected to the motor assembly, for moving the upper and lower lid members successively towards and away from each other to cause the flexible casing member to be disposed from and returned to a cylindrical shape during a cycle of movement and to rotate the wheel member to cause the novelty device to rotate about the pivot member, whereby the container appearance can amuse an observer by apparently deviating from its normally stationary solid configuration and returning to that configuration;

means for monitoring the movement of the novelty device, and means for driving the motor assembly in response to the monitoring means to ensure that the novelty device is returned to a cylindrical shape in a stationary position.

13. The novelty device of claim 12 further including means for sensing sound to enable an operation of the motor assembly in response to the sound.

14. The novelty device of claim 13 wherein the biasing means includes a coiled spring to bias the upper lid member away from the lower lid member.

15. The novelty device of claim 14 wherein the means for sensing sound includes a microphone mounted on the lower lid member.

* * * * *